US010481513B2

(12) United States Patent
Miyajima et al.

(10) Patent No.: US 10,481,513 B2
(45) Date of Patent: Nov. 19, 2019

(54) TONER FOR ELECTROSTATIC CHARGE DEVELOPMENT

(71) Applicant: Konica Minolta, Inc., Tokyo (JP)

(72) Inventors: Kenshi Miyajima, Tokyo (JP); Kouji Sugama, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/241,353

(22) Filed: Jan. 7, 2019

(65) Prior Publication Data

US 2019/0212665 A1 Jul. 11, 2019

(30) Foreign Application Priority Data

Jan. 10, 2018 (JP) ..... 2018-001757

(51) Int. Cl.

| | |
|---|---|
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0819* (2013.01); *G03G 9/0808* (2013.01); *G03G 9/0817* (2013.01); *G03G 9/0821* (2013.01); *G03G 9/08797* (2013.01); *G03G 9/097* (2013.01); *G03G 9/09708* (2013.01)

(58) Field of Classification Search

CPC . G03G 9/0819; G03G 9/0821; G03G 9/09708
USPC ..... 430/108.6
See application file for complete search history.

(56) References Cited

U.S. PATENT DOCUMENTS

2001/0051309 A1* 12/2001 Nagahama ..... G03G 9/08755 430/108.23
2018/0341191 A1* 11/2018 Murai ..... G03G 9/09725

FOREIGN PATENT DOCUMENTS

JP H11-015204 A 1/1999

* cited by examiner

*Primary Examiner* — Mark A Chapman
(74) *Attorney, Agent, or Firm* — Lucas & Mercanti, LLP

(57) ABSTRACT

The toner for electrostatic charge development includes a toner particle including: a toner base particle containing a binder resin and a release agent; and an external additive containing titanium dioxide. The number fraction of the toner particle containing the titanium dioxide is 0.1% or more and 2.0% or less.

4 Claims, No Drawings

TONER FOR ELECTROSTATIC CHARGE DEVELOPMENT

CROSS REFERENCE TO RELATED APPLICATIONS

The entire disclosure of Japanese patent application Ser. No. 2018-001757 filed on Jan. 10, 2018, is incorporated herein by reference in its entirety.

BACKGROUND

Technological Field

The present invention relates to a toner for electrostatic charge development.

Description of Related Art

Higher printing speed and output of satisfactory images without image failure have been recently desired in the field of production printing.

Increase of a transfer electric field and increase of electric charge on toner are expected as possible methods for higher printing speed.

If electric charge on toner is increased, part of the toner is excessively charged and remains on a photoconductor without being transferred, and strongly electrostatically adheres to the photoconductor. A toner containing a specific compound to prevent adhesion to a photoconductor is known (e.g., Japanese patent application Laid-Open No. H11-15204).

The toner according to Japanese patent application Laid-Open No. H11-15204 includes a toner particle and an inorganic fine particle. The toner particle contains a binder resin and one or both of carbon black and an azo iron compound. In this way, the toner according to Japanese patent application Laid-Open No. H11-15204 prevents the toner from being excessively charged by the carbon black or azo iron compound contained therein.

In conventional techniques, a photoconductor and excessively charged toner adhere to each other in some cases, resulting in deterioration of cleanability. The toner according to Japanese patent application Laid-Open No. H11-15204 has insufficient transfer properties in some cases because the specific carbon black or specific azo iron compound lowers the resistance value of the toner particle. Thus, conventional techniques have difficulty in imparting transfer properties and cleanability in combination to toner.

SUMMARY

An object of the present invention is to provide a toner for electrostatic charge development with transfer properties and cleanability in combination.

To achieve at least one of the abovementioned objects, according to an aspect of the present invention, a toner for electrostatic charge development reflecting one aspect of the present invention comprises a toner particle, the toner particle comprising: a toner base particle containing a binder resin and a release agent; and an external additive containing titanium dioxide, in which the number fraction of the toner particle containing the titanium dioxide is 0.1% or more and 2.0% or less.

DETAILED DESCRIPTION OF EMBODIMENTS

Hereinafter, one or more embodiments of the present invention will be described. However, the scope of the invention is not limited to the disclosure embodiments.

Hereinafter, an embodiment of the present invention will be described in detail.

Configuration of Toner

The toner (toner for electrostatic charge development) may be a one-component developer or a two-component developer. Toner as a one-component developer consists of a toner particle. Toner as a two-component developer consists of a toner particle and a carrier particle. In the present embodiment, the toner particle includes: a toner base particle containing a binder resin and a release agent; and an external additive containing titanium dioxide.

Examples of the carrier particle include magnetic particles consisting of conventionally known materials including metals such as iron, ferrite, and magnetite, and alloys of any of the metals and other metal such as aluminum and lead. Examples of the carrier particle include covered carrier particles including a core material particle consisting of a magnetic substance and a covering material layer covering the surface; and carrier particles dispersed in resin such that a fine powder of a magnetic substance is dispersed in a resin. The carrier particle is preferably a covered carrier particle to prevent the carrier particle from adhering to a photoconductor.

The core material particle is, for example, a magnetic substance to be strongly magnetized in the direction of a magnetic field. One magnetic substance may be used singly, and two or more magnetic substances may be used in combination. Examples of magnetic substances include metals with ferromagneticity such as iron, nickel, and cobalt; alloys or compounds containing any of the metals; and alloys which exhibit ferromagneticity by heating.

Examples of metals with ferromagneticity and compounds containing any of them include iron, ferrite represented by formula (a), and magnetite represented by formula (b). M in formula (a) and formula (b) denotes one or more monovalent or divalent metals selected from the group consisting of Mn, Fe, Ni, Co, Cu, Mg, Zn, Cd, and Li.

$$MO.Fe_2O_3 \qquad \text{formula (a):}$$

$$MFe_2O_4 \qquad \text{formula (b):}$$

Examples of alloys with ferromagneticity include Hensler alloys such as manganese-copper-aluminum and manganese-copper-tin, and chromium dioxide.

Ferrite is preferred for the core material particle. The specific gravity of a covered carrier particle is lower than that of metal constituting the core material particle. Accordingly, ferrite can lower the impact of stirring in a developing device.

Any known resin used for covering a core material particle in a carrier particle can be used for the covering material. The covering material is preferably a resin having a cycloalkyl group to reduce the moisture adsorption of the carrier particle and enhance the adhesion of the covering layer to the core material particle. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. The cycloalkyl group is preferably a cyclohexyl group or a cyclopentyl group, and more preferably a cyclohexyl group for the adhesion between the covering layer and the ferrite particle. One covering material may be used singly, and two or more covering materials may be used in combination.

The weight-average molecular weight, Mw, of the resin having a cycloalkyl group is, for example, preferably 10,000 to 800,000, and more preferably 100,000 to 750,000. The content of the cycloalkyl group in the resin is, for example, 10 to 90 mass %. The content of the cycloalkyl group in the resin can be determined by a known instrumental analysis such as P-GC/MS and $^1$H-NMR.

The average particle size of the carrier particle is preferably 20 to 100 μm, and more preferably 25 to 80 μm, as a volume-based median diameter. The volume-based median diameter of the carrier particle can be measured, for example, by using a laser diffraction particle size distribution analyzer equipped with a wet disperser (HELOS; Sympatec GmbH).

The mixing ratio (mass ratio) between the toner particle and the carrier particle is preferably toner particle:carrier particle=1:100 to 30:100, and more preferably 3:100 to 20:100 for chargeability and storability, though the mixing ratio is not limited thereto.

Binder Resin

The binder resin contains amorphous resin and crystalline resin.

The amorphous resin substantially lacks crystallinity, and, for example, includes an amorphous part in the resin. Examples of the amorphous resin include amorphous polyester resin, vinyl resin, urethane resin, urea resin, and amorphous modified polyester resin part of which has been modified. The amorphous resin can be synthesized, for example, by using a known method. One amorphous resin may be used singly, and two or more amorphous resins may be used in combination.

The molecular weights (weight-average molecular weight and number-average molecular weight) of the amorphous polyester resin in GPC can be determined, for example, as follows. The high-performance gel permeation chromatograph "HLC-8120GPC" (from Tosoh Corporation) and the column "TSKguardcolumn+TSKgel SuperHZ-M triple" (from Tosoh Corporation) are used, and tetrahydrofuran (THF) as a carrier solvent is flowed at a flow rate of 0.2 mL/min while the column temperature is retained at 40° C. A measurement sample (resin) is dissolved in tetrahydrofuran to a concentration of 1 mg/mL, which is treated with an ultrasonic disperser at room temperature for 5 minutes and then with a membrane filter of 0.2 μm pore size for preparation. The resulting sample solution in a volume of 10 μL is injected into the apparatus together with the carrier solvent and subjected to detection with a refractive index detector (RI detector). The molecular weight distribution of the measurement sample is calculated on the basis of a calibration curve prepared by using monodispersed polystyrene standard particles. Ten standard polystyrenes are used to determine the calibration curve. This measurement method is applicable to any resin soluble in THF.

The vinyl resin is a resin formed through polymerization of a monomer including a compound having a vinyl group or a derivative thereof. One vinyl resin may be used singly, and two or more vinyl resins may be used in combination. Examples of the vinyl resin include styrene-(meth)acrylic resin.

The styrene-(meth)acrylic resin has a molecular structure of a radical polymer of a compound having a radical-polymerizable unsaturated bond. The styrene-(meth)acrylic resin can be synthesized, for example, through radical polymerization of a compound having a radical-polymerizable unsaturated bond. One compound having a radical-polymerizable unsaturated bond may be used singly, and two or more compounds having a radical-polymerizable unsaturated bond may be used in combination. Examples of compounds having a radical-polymerizable unsaturated bond include styrene and derivatives thereof, and (meth) acrylic acid and derivatives thereof.

Examples of styrene and derivatives thereof include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of (meth)acrylic acid and derivatives thereof include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate.

The vinyl resin content of the amorphous resin is preferably 50 mass % or more. In forming a particle by aggregating crystalline resin in an aqueous solvent, the vinyl resin can prevent the crystalline resin from being insufficiently dispersed in the amorphous resin.

The crystalline resin is a resin having crystallinity Here, the term "crystallinity" means that a clear endothermic peak, not a stepwise endothermic change, is observed in differential scanning calorimetry (DSC). The term "clear endothermic peak" specifically refers to an endothermic peak with a full width at half maximum of 15° C. or smaller observed in DSC at a warming rate of 10° C./min.

The crystalline resin is preferably crystalline polyester resin for good low-temperature fixability. The melting point of the crystalline polyester resin is preferably 55 to 80° C. to sufficiently soften the toner to ensure sufficient low-temperature fixability, and more preferably 75 to 85° C. for well-balanced improvement of various properties. The melting point of the crystalline polyester resin can be controlled through the resin composition (e.g., the type of monomer). One crystalline polyester resin may be used, and two or more crystalline polyester resins may be used in combination.

Crystalline polyester can be produced, for example, by using a known synthesis method with dehydration condensation reaction between polycarboxylic acid and polyhydric alcohol.

Examples of the polycarboxylic acid include saturated aliphatic dicarboxylic acid such as succinic acid, sebacic acid, and dodecanedioic acid; alicyclic dicarboxylic acid such as cyclohexanedicarboxylic acid; aromatic dicarboxylic acid such as phthalic acid, isophthalic acid, and terephthalic acid; trivalent or higher-valent polycarboxylic acid such as trimellitic acid and pyromellitic acid; acid anhydrides of them; and $C_{1-3}$ alkyl esters of them. The polycarboxylic acid is preferably aliphatic dicarboxylic acid.

Examples of the polyhydric alcohol include aliphatic diol such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and trihydric or higher-hydric alcohol such as glycerin, pentaerythritol, trimethylolpropane, and sorbitol. The polyhydric alcohol is preferably aliphatic diol.

The crystalline resin is more preferably hybrid crystalline polyester resin. The hybrid crystalline polyester resin has a structure in which a crystalline polyester resin unit and an amorphous resin unit are chemically bonded.

A "crystalline polyester resin unit" is a part derived from crystalline polyester resin in the hybrid crystalline polyester resin. An "amorphous resin unit" is a part derived from resin with no crystallinity (amorphous resin) in the hybrid crystalline polyester resin.

The above-described crystalline polyester resin can be used for the crystalline polyester resin mentioned here. In addition, the above-described amorphous resin can be used for the amorphous resin mentioned here.

In a region where crystalline polyester resin units are bonded together, amorphous resin units are bonded together, or these resin units are bonded together chemically in the hybrid crystalline polyester resin, the crystalline polyester resin units and/or amorphous resin units may be positioned continuously or randomly. These units may be linearly linked, and one chain may be graft-bonding to another chain.

Each chemical bond is, for example, an ester bond, or a covalent bond derived from addition reaction of an unsaturated group. The hybrid crystalline polyester resin can be obtained by using a known method of bonding a crystalline polyester resin unit and an amorphous resin unit together via a chemical bond. For example, the binder resin can be produced by using a method including: polymerizing a monomer to constitute resin units in a main chain and a bireactive monomer; and polymerizing or reacting one or both of a monomer to constitute resin units in a side chain and a crystal-nucleating agent in the presence of the main chain precursor obtained.

In addition, a substituent such as a sulfonic acid group, a carboxy group, and a urethane group can be further introduced into the hybrid crystalline polyester resin. The substituent may be introduced into a crystalline polyester resin unit or an amorphous resin unit.

The structures and amounts of the main chain and side chains in the resin obtained can be confirmed or estimated, for example, by using a known instrumental analysis such as nuclear magnetic resonance (NMR) and electrospray ionization/mass spectrometry (ESI-MS) for the binder resin or a hydrolysate thereof.

In synthesis of the above resin units, a chain transfer agent to adjust the molecular weight of a resin to be obtained may be further contained in raw materials including the monomers of the resin units. One chain transfer agent may be used singly, and two or more chain transfer agents may be used in combination. Examples of chain transfer agents include 2-chloroethanol, mercaptan such as octylmercaptan, dodecylmercaptan, and t-dodecylmercaptan, and styrene dimer.

Here, "graft bonding" refers to chemical bonding between a polymer as a stem and another polymer (or monomer) as a branch. To totally enhance the properties of the toner as intended, the hybrid crystalline polyester resin preferably has a structure in which a crystalline polyester resin unit is graft-bonding to an amorphous resin unit. The hybrid crystalline polyester resin is preferred to sufficiently enhance the crystallinity of the hybrid crystalline polyester resin in the toner base particle.

The contents of the crystalline polyester resin unit and the amorphous resin unit in the hybrid crystalline polyester resin can be appropriately determined in a manner such that the advantageous effect of the present embodiment can be obtained. If the content of the amorphous resin unit in the hybrid crystalline polyester resin is excessively low, for example, the hybrid crystalline polyester resin may be insufficiently dispersed in the toner base particle, and if the content of the amorphous resin unit in the hybrid crystalline polyester resin is excessively high, the low-temperature stability may be insufficient. For these viewpoints, the content is preferably 5 to 30 mass %, and, for enhancement of the high-temperature storability and homogeneous charging, the content is more preferably 5 to 20 mass %.

From the same viewpoints, the content of the crystalline polyester resin unit in the hybrid crystalline polyester resin is preferably 65 to 95 mass %, and more preferably 70 to 90 mass %. The hybrid crystalline polyester resin may further contain an additional component other than the units in a manner such that the advantageous effect of the present embodiment can be obtained. Examples of the additional component include other resin units and various additives to be added to the toner base particle.

Release Agent

Examples of the release agent (wax) include hydrocarbon wax and ester wax. Examples of the hydrocarbon wax include low-molecular-weight polyethylene wax, low-molecular-weight polypropylene wax, Fischer-Tropsch wax, microcrystalline wax, and paraffin wax. Examples of the ester wax include carnauba wax, pentaerythritol behenate, behenyl behenate, and behenyl citrate.

The content of the release agent based on 100 parts by mass of the binder resin is preferably 3 to 20 parts by mass, and more preferably 5 to 15 parts by mass.

Colorant

Any known inorganic or organic colorant used as a colorant for color toners can be used. Examples of colorants include carbon black, magnetic substances, pigments, and dyes. One colorant may be used singly, and two or more colorants may be used in combination.

Examples of carbon black include channel black, furnace black, acetylene black, thermal black, and lamp black. Examples of magnetic substances include ferromagnetic metals such as iron, nickel, and cobalt, alloys containing any of them, and ferromagnetic metal compounds such as ferrite and magnetite.

Examples of pigments include C.I. Pigment Reds 2, 3, 5, 7, 15, 16, 48:1, 48:3, 53:1, 57:1, 81:4, 122, 123, 139, 144, 149, 166, 177, 178, 208, 209, 222, 238, and 269; C.I. Pigment Oranges 31 and 43; C.I. Pigment Yellows 3, 9, 14, 17, 35, 36, 65, 74, 83, 93, 94, 98, 110, 111, 138, 139, 153, 155, 180, 181, and 185; C.I. Pigment Green 7; C.I. Pigment Blues 15:3, 15:4, 60; and phthalocyanine pigments with a central metal of zinc, titanium, magnesium, or another metal.

Examples of dyes include C.I. Solvent Reds 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176, and 179; pyrazolotriazole azo dye; pyrazolotriazole azomethine dye; pyrazolone azo dye; pyrazolone azomethine dye; C.I. Solvent Yellows 19, 44, 77, 79, 81, 82, 93, 98, 103, 104, 112, and 162; C.I. Solvent Blues 25, 36, 60, 70, 93, and 95.

External Additive

The external additive controls the fluidity, chargeability, and so forth of the toner particle. In the present embodiment, titanium dioxide as an external additive is adhering to the surface of part of the toner base particle.

The titanium dioxide may be of anatase-type or of rutile-type, or metatitanic acid.

The titanium dioxide may be synthesized or purchased as a commercially available product. Examples of commercially available titanium dioxide include KA-10, KA-15, KA-20, KA-30, KA-35, KA-80, KA-90, and STT-30 (from Titan Kogyo, Ltd.); KR-310, KR-380, KR-460, KR-480, KR-270, and KV-300 (from Titan Kogyo, Ltd.); MT-150A, MT-600B, MT-100S, MT-500B, JR-6025, and JR-600A (from TAYCA CORPORATION); and P25 (from NIPPON AEROSIL CO., LTD.).

The number-average primary particle size of the titanium dioxide is preferably in the range of 10 to 300 nm. If the primary particle size of the titanium dioxide is smaller than 10 nm, the titanium dioxide may fail to disperse homogeneously on the toner surface because of the high aggregability. If the number-average primary particle size of the titanium dioxide is larger than 300 nm, on the other hand, the titanium dioxide may fail to adhere to the surface of the toner base particle.

The number-average primary particle size of the external additive can be determined, for example, through image processing for an image taken with a transmission electron microscope, and can be adjusted, for example, through classification or mixing of classified products.

For cleanability, the number fraction of the toner particle containing the titanium dioxide to the total number of the toner particle is preferably 0.1% or more, and more preferably 0.3% or more. For transfer properties, the number fraction of the toner particle containing the titanium dioxide to the total number of the toner particle is preferably 2.0% or less, and more preferably 1.0% or less.

The number fraction of the toner particle containing the titanium dioxide can be calculated, for example, in the following manner. A toner is inserted into a scanning electron microscope (JSM-7401F; from JEOL Ltd.), and subjected to quantitative analysis with a ZAF method for silicon, titanium, carbon, and oxygen as elements to be measured by using an energy dispersive X-ray analyzer (JED-2300; from JEOL Ltd.) with an observation magnification of 2,000×, an acceleration voltage of 20 kV, and an irradiation time of 200 s. Point analysis is performed for three points per toner particle, and the mass fractions of titanium element acquired are averaged, and the average value is determined as the mass fraction of titanium element in the measured toner. Calculation of the mass fraction is performed for 10,000 toner particles, and the number fraction of toner with 0.01 mass % or more of titanium element per toner particle is calculated.

For cleanability, the content of titanium element derived from the titanium dioxide on average per toner particle is preferably 0.01 mass % or more, more preferably 0.02 mass % or more, and even more preferably 0.04 mass % or more. For transfer properties, the content of titanium element derived from the titanium dioxide on average per toner particle is preferably 1.00 mass % or less, and more preferably 0.50 mass % or less.

The content of titanium element derived from the titanium dioxide on average per toner particle can be determined by averaging the mass fractions of titanium element for 10,000 toner particles with 0.01 mass % or more of titanium element per toner particle.

The surface of the titanium dioxide has been preferably hydrophobized. A known surface treating agent is used for the hydrophobization. One surface treating agent may be used singly, and two or more surface treating agents may be used in combination. Examples of surface treating agents include silane coupling agent, silicone oil, titanate coupling agent, aluminate coupling agent, fatty acid, fatty acid metal salt, esterified products thereof, and rosin acid.

Examples of the silane coupling agent include dimethyldimethoxysilane, hexamethyldisilazane (HMDS), methyltrimethoxysilane, isobutyltrimethoxysilane, and decyltrimethoxysilane. Examples of the silicone oil include cyclic compounds and linear and branched organosiloxane, more specifically, organosiloxane oligomers, octamethylcyclotetrasiloxane, decamethylcyclopentasiloxane, tetramethylcyclotetrasiloxane, and tetravinyltetramethylcyclotetrasiloxane.

Another example of the silicone oil is a highly reactive silicone oil with at least an end modified in which a modifying group is introduced, for example, into a side chain, one end, both ends, one end of a side chain, or both ends of a side chain, and one type or more types of modifying groups may be introduced, and examples of the modifying group include alkoxy, carboxy, carbinol, modification with higher fatty acid, phenol, epoxy, methacryl, and amino.

In addition to the external additive, an additional external additive may be added in a manner such that the advantageous effect of the titanium dioxide is not inhibited. Examples of the additional external additive include silica particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles. One additional external additive may be used singly, and two or more additional external additives may be used in combination.

The additional external additive more preferably contains a silica particle produced by using a sol-gel method. Because of the inherent feature of narrow particle size distribution, the silica particle produced by using a sol-gel method is preferred for preventing unevenness of the adhesion strength of the external additive to the toner base particle.

The number-average primary particle size of the silica particle is preferably 70 to 200 nm. If the number-average primary particle size is in this range, the silica particle is generally larger than other external additives. Hence, the silica particle serves as a spacer in a two-component developer. This is preferable for preventing smaller, other external additives from being buried in the toner base particle when a two-component developer is stirred in a developing device. This is also preferable for preventing the fusion of the toner base particles.

The surface of the additional external additive has been preferably hydrophobized by using the aforementioned method.

The loading of the external additive is preferably 0.1 to 10.0 mass %, and more preferably 1.0 to 3.0 mass % to the total of the toner particle.

The toner when being a one-component developer is composed of a toner particle itself, and composed of a toner particle and a carrier particle when being a two-component developer. The content of the toner particle (toner concentration) in the case of a two-component developer may be the same as those for common two-component developers, and the content is, for example, 4.0 to 8.0 mass %.

To further enhance cleanability and transfer properties, a lubricant can be used as an external additive. Examples of the lubricant include higher fatty acid metal salts including stearates of zinc, aluminum, copper, magnesium, and calcium, oleates of zinc, manganese, iron, copper, and magnesium, palmitates of zinc, copper, magnesium, and calcium, linoleates of zinc and calcium, and ricinoleates of zinc and calcium.

The toner base particle may further contain an additional component in addition to the binder resin and the release agent in any mariner such that the advantageous effect of the present embodiment is exerted. Examples of the additional component include a charge control agent. One charge control agent may be used singly, and two or more charge control agents may be used in combination.

Examples of the charge control agent include nigrosine dyes, metal salts of naphthenic acid or higher fatty acids, alkoxylated amines, quaternary ammonium salt compounds, azo metal complexes, and metal salts and metal complexes of salicylic acid.

To appropriately control the particle size and circularity of the toner base particle, the toner base particle is preferably a polymer toner prepared in an aqueous medium, rather than a ground toner, and more preferably a toner base particle formed by using an aggregation method with emulsion association.

Properties of Toner

A two-component developer can be produced by mixing appropriate amounts of the toner particle and the carrier particle. Examples of mixing apparatuses for the mixing include a Nauta mixer, and W-cone and V-mixing machines.

The size and shape of the toner particle can be appropriately determined in a manner such that the advantageous effect of the present embodiment can be obtained. For example, the volume-average particle size of the toner particle is 3.0 to 8.0 μm, and the average circularity of the toner particle is 0.920 to 1.000.

Measurement and calculation for the number-average particle size of the toner particle can be performed by using an apparatus in which a computer system for data processing is connected to a "Multisizer 3" (from Beckman Coulter Inc.). The number-average particle size of the toner particle can be adjusted, for example, through conditions for temperature and stirring in production of the toner particle, classification of the toner particle, or mixing of classified products of the toner particle.

The average circularity of the toner particle can be determined, for example, by using the flow particle image analyzer "FPIA-3000" (from SYSMEX CORPORATION) as follows: for a given number of toner particles, the peripheral length of a circle having a projection area of a particle image, L1, and the peripheral length of the corresponding particle projection image, L2, are determined to calculate the circularity, C, from expression (c); and the sum total of the circularities, C, is divided by the given number. The average circularity of the toner particle can be adjusted, for example, through the degree of aging of the resin particle in production of the toner particle, heating of the toner particle, or mixing of toner particles with different circularities.

$$C=L1/L2 \qquad \text{expression (c):}$$

Similarly, the size and shape of the carrier particle can be appropriately determined in a mariner such that the advantageous effect of the present embodiment can be obtained. For example, the volume-average particle size of the carrier particle is 15 to 100 μm. The volume-average particle size of the carrier particle can be determined, for example, in a wet method by using the laser diffraction particle size distribution analyzer "HELOS KA" (from Japan Laser Corp.). The volume-average particle size of the carrier particle can be adjusted, for example, through a method of controlling the particle size of the core material particle by production conditions for the core material particle, classification of the carrier particle, or mixing of classified products of the carrier particle.

Method for Producing Toner

The toner can be produced by using a known method. Examples of the method for producing the toner include a kneading/grinding method, a suspension polymerization method, an emulsion aggregation method, a dissolution/suspension method, a polyester elongation method, and a dispersion polymerization method. Here, a method for producing a toner with the kneading/grinding method will be described.

The kneading/grinding method is a method including kneading following mixing of at least a binder resin and a colorant, and then grinding the resultant to obtain a toner. After the grinding, classification is performed by using a known classifier or the like, as necessary. Before the kneading, the binder resin, the colorant, and an optional additive such as a release agent and a charge control agent may be sufficiently mixed together by using a mixing machine such as a Henschel mixer and a ball mill.

(1) Kneading

A common kneader such as a twin-screw extrusion kneader, a triple roll mill, and a LABO PLASTOMILL can be used for the kneading. An internal additive may be added in the kneading. It is preferred to heat in the kneading, and the heating conditions can be appropriately set.

Typically, the kneading with heating is followed by cooling and then the next step, grinding. The cooling rate after the kneading can be appropriately set.

(2) Grinding

For example, a mechanical grinder such as a Turbo Mill, or an airflow grinder (jet mill) can be used for the grinding. Before the grinding, a kneaded product cooled and solidified as chips through the kneading may be coarsely ground by using a hammer mill, a feather mill, or the like to a size acceptable for a grinder.

The toner particle obtained in the grinding may be classified through classification, as necessary, to obtain a toner particle with a volume-based median diameter in an intended range. In the classification, a conventional gravity classifier, a centrifugal classifier, an inertial classifier (e.g., a classifier utilizing the Coanda effect), or the like is used, where a fine powder (a toner particle with a diameter below an intended range) and a coarse powder (a toner particle with a diameter over an intended range) are removed.

The volume-based median diameter of the particle obtained after the grinding or the classification (hereinafter, also referred to as "base particle") is preferably 4.8 to 13.2 μm. The coefficient of variation (CV value) in the volume-based particle size distribution for the base particle is preferably 10 to 32. A coefficient of variation (CV value) in a volume-based particle size distribution indicates the degree of dispersion in the particle size distribution for a toner particle on the basis of volume, and defined as expression (d).

$$\text{CV value (\%)}=(\text{Standard deviation in number-based particle size distribution})/(\text{Median diameter (D50v) in number-based particle size distribution})\times 100 \qquad \text{expression (d):}$$

In obtaining a toner by using the kneading/grinding method, the volume-based median diameter of the toner can be controlled through grinding conditions (rotational frequency of a grinder, grinding time), classification conditions, treatment conditions in the following circularity control, and treatment conditions in external additive loading (rotational frequency of a mixing machine, mixing time, etc.) described later.

(3) Circularity Control (Spheroidization)

In obtaining a toner by using the kneading/grinding method, circularity control to control the average circularity of the toner to satisfy expression (c) is preferably included. In this case, it is preferred to perform circularity control at least for non-white toners among a white toner and non-white toners, and it is preferred to perform circularity control for both non-white toners and a white toner. That is, a preferred embodiment is such that the kneading to mix at least a binder resin and a colorant is performed, the grinding to grind the resulting mixture is performed, and circularity control is then performed to afford non-white toners (preferably, non-white toners and a white toner).

Examples of the circularity control include heating the toner base particle. The circularity of the toner base particle can be controlled through the heating temperature and the retention time. The circularity can be close to 1 by raising the heating temperature or extending the retention time. However, excessively high heating temperature is not preferred because the re-aggregation or interparticle fusion of a toner particle is promoted. In addition, excessively long retention time is not preferred because the domain structure in a toner (positioning of non-binder components such as wax and crystalline polyester, assuming the binder resin as a matrix) changes.

The heating temperature in the circularity control can be appropriately adjusted so that Sc/Sw satisfies expression (c); however, the heating temperature is preferably 70 to 95° C., and more preferably 75 to 90° C. In using amorphous polyester resin, the circularity control is typically performed at a temperature around Tg to softening point of the amorphous polyester resin. Here, proper temperature also depends on other constitutional materials (e.g., the amount of wax or colorant), and hence heating temperature can be appropriately set in view of these materials. The retention time at heating temperature can be appropriately adjusted so that Sc/Sw satisfies expression (c) in view of the heating time. The circularity can be controlled in a manner such that circularity is measured during heating for a particle with a particle size as a volume based median diameter of 2 μm or larger by using a circularity analyzer, and it is appropriately determined whether the circularity is a desired circularity.

Measurement of Glass Transition Temperature of Amorphous Polyester Resin

The glass transition temperature (Tg) of amorphous polyester resin can be measured, for example, by using a "Diamond DSC" (from PerkinElmer Inc.). First, 3.0 mg of a measurement sample (resin) is encapsulated in an aluminum pan, which is set in a sample holder of the "Diamond DSC". The aluminum pan when being empty is used as a reference. Then, a DSC curve is acquired under measurement conditions (warming/cooling conditions) consisting of a first warming process of warming from 0° C. to 200° C. at a warming rate of 10° C./min, a cooling process of cooling from 200° C. to 0° C. at a cooling rate of 10° C./min, and a second warming process of warming from 0° C. to 200° C. at a warming rate of 10° C./min, in the order presented. In the DSC curve acquired in the measurement, a baseline before the rising of a first endothermic peak in the second warming process is extended, and a tangent is drawn between the rising point of the first peak and the peak top to give the maximum slope, and a point of intersection between the extended baseline and the tangent is defined as the glass transition temperature (Tg).

The circularity control may be performed with dry heating or wet heating. Wet heating is a method of heating the toner base particle dispersed in an aqueous medium. In wet heating, a surfactant or the like may be added for the purpose of improving the dispersion stability of the toner base particle. Examples of the surfactant include anionic surfactants such as alkylbenzenesulfonates, α-olefinsulfonates, and phosphates; cationic surfactants including cationic surfactants as amine salt such as alkylamine salts, aminoalcohol-fatty acid derivatives, polyamine-fatty acid derivatives, and imidazoline, and cationic surfactants as quaternary ammonium salt such as alkyltrimethylammonium salts, dialkyldimethylammonium salts, alkyldimethylbenzylammonium salts, pyridinium salts, alkylisoquinolinium salts, and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine, and N-alkyl-N,N-dimethylammonium betaine, and an anionic surfactant or cationic surfactant having a fluoroalkyl group is also applicable.

The method for producing a toner particle with the kneading/grinding method may include (4) filtering/washing, (5) drying, and (6) external additive loading after the circularity control.

(4) Filtering/Washing

Filtering and washing are performed in the filtering/washing, where the filtering is such that the dispersion of the toner particle obtained is cooled to provide a cooled slurry, and the cooled dispersion of the toner particle is subjected to solid-liquid separation with a solvent such as water and the toner particle is collected therefrom through filtration, and the washing is such that the toner particle collected through filtration (a mass like a cake) is removed of attached substances including the surfactant. Specific examples of the solid-liquid separation and washing include, but are not limited to, a centrifugation method, a vacuum filtration method with an aspirator, a Nutsche, or the like, and a filtration method with a filter press or the like. In this filtering/washing, for example, pH adjustment or grinding may be performed. Such operations may be repeated.

(5) Drying

In drying, the washed toner particles is dried. Examples of dryers for this drying include, but are not limited to, an oven, a spray dryer, a vacuum freeze dryer, a vacuum dryer, a static shelf dryer, a mobile shelf dryer, a fluidized bed dryer, a rotary dryer, and a stirring dryer. The moisture content of the dried toner particle is preferably 5 mass % or less, and more preferably 2 mass % or less as measured in Karl Fischer coulometric titration.

If the dried toner particle is forming an agglomerate via weak interparticle attraction, the agglomerate may be disintegrated. Examples of disintegrating apparatuses include mechanical disintegrating apparatuses such as a jet mill, a Comil, a Henschel mixer, a coffee mill, and a food processor.

(6) External Additive Loading

In external additive loading, titanium dioxide and an external additive, such as a charge control agent and an inorganic fine particle, an organic fine particle, and a lubricant, for improved fluidity or chargeability and enhanced cleanability, are added to the dried toner base particle. Regarding conditions for the external additive loading, for example, the external additive loading is performed at a temperature of 30 to 50° C. under the atmospheric pressure and the mixing time is 20 minutes to 1 hour. Examples of apparatuses for the external additive loading include various known mixing apparatuses such as a TURBULA mixer, a Henschel mixer, a Nauta mixer, a V-mixing machine, and a Sample Mill. As necessary, sieve classification may be performed to set the particle size distribution of the toner in a proper range.

In the present embodiment, titanium dioxide is disposed on only part of the toner base particle. Hence, part of the toner base particle and titanium dioxide are mixed together to produce a toner particle with titanium dioxide adhering thereto. Then, a toner particle without titanium dioxide adhering thereto or with another external additive adhering thereto and the toner particle with titanium dioxide adhering thereto are mixed to produce a toner.

Why the toner produced as described above can exhibit both transfer properties and cleanability is inferred as follows. Part of the toner particle in the present embodiment includes the toner base particle and titanium dioxide fixed to the surface of the toner base particle. The number fraction of the toner particle containing titanium dioxide is 0.1 to 2.0%.

Most of the toners currently distributed in the market do not contain titanium dioxide as an external additive. Accordingly, toners distributed in the market have high chargeability, and generally have good transfer properties. However, electric charge on such toner is according to a certain distribution. If the number fraction of the toner particle containing titanium dioxide is more than 2.0%, some excessively charged toner particles strongly electrostatically adhere to a photoconductor, and remain on the photoconductor without being transferred. Since the toner remaining on the photoconductor is strongly adhering to the photoconductor, resulting in low fluidity, the toner cannot be removed in a cleaning section, leading to the occurrence of cleaning failure.

On the other hand, some of the toners distributed in the market contain titanium dioxide as an external additive. Such toners have low chargeability and high fluidity, and hence have good cleanability. However, such toners have poor transfer properties due to the low chargeability, and frequently remain on a photoconductor. If the number fraction of the toner particle containing titanium dioxide is 1.0% or more as in the present embodiment, cleaning performance for the remaining toner particle is assisted by the toner particle containing titanium dioxide.

EXAMPLES

The present invention will be more specifically described with the following Examples and Comparative Examples. Hereinafter, operations were performed at room temperature (20° C.), unless otherwise stated. It should be noted that the present invention is never limited to the following Examples, etc.

Synthesis of Amorphous Polyester Resin (AP Resin 1)

The following raw material monomers of polycondensation resin and 1.0 part by mass of $Ti(n\text{-}OBu)_4$ as an esterification catalyst were put in a four-necked flask equipped with a nitrogen inlet tube, a dewatering tube, and a stirrer, and reacted at 180° C. for 4 hours.

Fumaric acid: 132 parts by mass

Terephthalic acid: 45 parts by mass

2-Mole propylene oxide adduct of bisphenol A: 500 parts by mass

Thereafter, the resultant was warmed to 210° C. at a rate of 10° C./hr, retained at 210° C. for 5 hours, and then reacted under reduced pressure (8 kPa) for 1 hour. Subsequently, the resultant was cooled to 200° C., and reacted under reduced pressure (20 kPa) for 1 hour to afford amorphous polyester resin (AP resin 1). The weight-average molecular weight (Mw) and glass transition temperature (Tg) of amorphous polyester resin (AP resin 1) obtained was 35,000 and 58° C., respectively.

Preparation of Amorphous Polyester Resin Particle Dispersion (AP Dispersion 1)

Thirty parts by mass of amorphous polyester resin (AP resin 1), remaining being melted, was transferred into the emulsifying disperser "Cavitron CD1010" (from EUROTEC K.K.) at a transfer rate of 100 parts by mass per minute. Concomitantly with the transfer of amorphous polyester resin (AP resin 1) melted, dilute aqueous ammonia with a concentration of 0.37 mass % (prepared by diluting 70 parts by mass of aqueous ammonia as a reagent with ion-exchanged water in an aqueous medium tank) was transferred, with heating to 100° C. by means of a heat exchanger, into the emulsifying disperser at a transfer rate of 0.1 L/min. The emulsifying disperser was operated at a rotor rotational frequency of 60 Hz and a pressure of 5 $kg/cm^2$ to prepare a dispersion containing an amorphous polyester resin particle having a volume-based median diameter of 180 nm (AP dispersion 1). The volume-based median diameter (D50) was determined by using the microtrac particle size distribution analyzer "UPA-150" (from Nikkiso Co., Ltd.).

Preparation of Release Agent Particle Dispersion (W1)

Paraffin wax (HNP 0190, from NIPPON SEIRO CO., LTD. (melting point: 81° C.)): 200 parts by mass Sodium dodecylsulfate: 20 parts by mass Ion-exchanged water: 2,200 parts by mass These materials were mixed together and heated to 95° C., and sufficiently dispersed by using an ULTRA-TURRAX (registered trademark, the same applied hereinafter) T50 from IKA. Thereafter, the resultant was dispersed by using a pressure-discharging Gaulin Homogenizer to prepare release agent particle dispersion (W1). The volume based median diameter of the release agent particle in the dispersion was 200 nm.

Preparation of Cyan Colorant Dispersion (Cy)

Sodium dodecylsulfate: 90 parts by mass

C.I. Pigment Blue 15:3: 200 parts by mass

Ion-exchanged water: 1,600 parts by mass

These components were mixed together to prepare a solution, and the solution was sufficiently dispersed by using an ULTRA-TURRAX T50 (from IKA), and then treated with an ultrasonic disperser for 20 minutes to prepare cyan colorant dispersion (Cy). The volume-based median diameter of the colorant in cyan colorant dispersion (Cy) obtained was 180 nm.

Production of Toner (1)

Into a reactor equipped with a stirrer, a temperature sensor, and a condenser, 540 parts by mass (with respect to the solid content) of amorphous polyester resin particle dispersion (AP dispersion 1), 30 parts by mass (with respect to the solid content) of colorant dispersion (Cy), and 60 parts by mass (with respect to the solid content) of release agent particle dispersion (W1) were loaded, and 5 mol/L aqueous solution of sodium hydroxide was then added thereto to adjust the pH to 10.

Subsequently, an aqueous solution prepared by dissolving 50 parts by mass of magnesium chloride in 50 parts by mass of ion-exchanged water was added thereto with stirring at 30° C. over 10 minutes. The system was warmed to 75° C. over 60 minutes from the initiation of warming, and the particle sizes of associated particles were measured by using a "Coulter Multisizer 3" (from Beckman Coulter Inc.), and the stirring speed was controlled to attain a volume-based median diameter of 6.0 μm. Thereafter, an aqueous solution prepared by dissolving 190 parts by mass of sodium chloride in 760 parts by mass of ion-exchanged water was added thereto to terminate the particle growth. The resultant was further stirred with heating at 76° C. to progress the fusion of particles.

Thereafter, when the average circularity as measured by using an "FPIA-3000" (from SYSMEX CORPORATION), an apparatus for measurement of the average circularity of the toner particle (HPF detection counts: 4,000), reached 0.957, cooling was performed to 30° C. at a cooling rate of 1° C./min.

Subsequently, solid-liquid separation was performed, and an operation of re-dispersing the dehydrated toner cake in ion-exchanged water followed by solid-liquid separation was repeated three times for washing, and the resultant was dried at 40° C. for 24 hours to afford toner particle (1×).

External additive loading was performed by adding 2.0 parts by mass of hydrophobic silica (number-average primary particle size =12 nm) to 200 parts by mass of toner particle (1×) followed by mixing by using a "Henschel mixer" (from Mitsui Miike Chemical Engineering Machinery, Co., Ltd.) with a blade circumferential speed of 30 m/sec at 32° C. for 20 minutes to afford cyan toner (A).

External additive loading was performed by adding 2.0 parts by mass of hydrophobic silica (number-average primary particle size=12 nm) and 0.1 parts by mass of hydrophobic titanium oxide (number-average primary particle size=20 nm) to 200 parts by mass of toner particle (1×) obtained followed by mixing by using a "Henschel mixer" (from Mitsui Miike Chemical Engineering Machinery, Co., Ltd.) with a blade circumferential speed of 30 m/sec at 32° C. for 20 minutes to afford cyan toner (B1).

By using a "Henschel mixer" (from Mitsui Miike Chemical Engineering Machinery, Co., Ltd.), 200 parts by mass of cyan toner (A) and 0.2 parts by mass of cyan toner (B1) obtained were mixed together with a blade circumferential speed of 30 m/sec at 32° C. for 5 minutes, and coarse particles were then removed with a sieve of 45 μm mesh size to afford cyan toner (1).

Cyan toner (1) was mixed with a ferrite carrier of 30 μm volume-average particle size covered with 2 parts by mass of copolymer resin of cyclohexyl methacrylate and methyl methacrylate (monomer mass ratio=1:1) so that the concentration of cyan toner (1) reached 7 mass %, and thus toner (1) was obtained.

Production of Toner (2) to Toner (5)

Cyan toner (B2) to cyan toner (B5) were produced in the same manner as for cyan toner (B1) except that the loading of titanium dioxide for cyan toner (B1) was changed to 0.3, 1.5, 2.5, and 5.0 parts by mass, respectively.

The loadings of titanium oxide for cyan toner (B1) to cyan toner (B5) are listed in Table 1.

TABLE 1

| | Titanium dioxide (part by mass) |
|---|---|
| Cyan toner (B1) | 0.1 |
| Cyan toner (B2) | 0.3 |
| Cyan toner (B3) | 1.5 |
| Cyan toner (B4) | 2.5 |
| Cyan toner (B5) | 5.0 |

Toner (2) to toner (12) were produced in the same manner as for toner (1) except that 0.2 parts by mass of cyan toner (B1) for toner (1) was changed as listed in Table 2.

Cyan toners (B) and the loadings thereof used for toner (1) to toner (12) are listed in Table 2.

TABLE 2

| Toner No. | Cyan toner (B) | Loading (part by mass) |
|---|---|---|
| Toner (1) | Cyan toner (B1) | 0.2 |
| Toner (2) | Cyan toner (B1) | 4.0 |
| Toner (3) | Cyan toner (B1) | 2.0 |
| Toner (4) | Cyan toner (B1) | 1.2 |
| Toner (5) | Cyan toner (B1) | 0.6 |
| Toner (6) | Cyan toner (B2) | 1.2 |
| Toner (7) | Cyan toner (B3) | 1.2 |
| Toner (8) | Cyan toner (B4) | 1.2 |
| Toner (9) | Cyan toner (B5) | 1.2 |
| Toner (10) | — | — |
| Toner (11) | Cyan toner (B2) | 0.1 |
| Toner (12) | Cyan toner (B2) | 6.0 |

The number fraction of a toner particle containing titanium dioxide and mass ratio of titanium per toner particle for toner (1) to toner (12) are listed in Table 3.

TABLE 3

| Toner No. | Number fraction of toner particle containing titanium dioxide (%) | Mass fraction of titanium per toner particle |
|---|---|---|
| Toner (1) | 0.10 | 0.01 |
| Toner (2) | 2.00 | 0.01 |
| Toner (3) | 1.00 | 0.01 |
| Toner (4) | 0.60 | 0.01 |
| Toner (5) | 0.30 | 0.01 |
| Toner (6) | 0.60 | 0.04 |
| Toner (7) | 0.60 | 0.01 |
| Toner (8) | 0.60 | 0.50 |
| Toner (9) | 0.60 | 1.00 |
| Toner (10) | 0 | — |
| Toner (11) | 0.05 | 0.01 |
| Toner (12) | 2.90 | 0.01 |

Evaluation Method

Evaluation of Transfer Properties

The copier "bizhub PRESS (registered trademark) C1070" (from Konica Minolta, Inc.) was customized to disable from controlling for temperature/humidity correction, and each toner produced was installed in the customized copier for evaluation. First, the amount of each toner to adhere to an A4 sheet of the wood-free paper "CF Paper" (from Konica Minolta, Inc.) was set to 4.0 g/m$^2$ under an environment of normal temperature and normal humidity (temperature: 20° C., humidity: 50% RH). Thereafter, an image of 100 mm×100 mm was output onto an A4 paper sheet of the wood-free paper "CF Paper" under an environment of high temperature and high humidity (temperature: 30° C., humidity: 80% RH). For each of the images obtained under normal temperature and normal humidity and under high temperature and high humidity, reflection density was measured by using the fluorescent spectrodensitometer FD-7 (from Konica Minolta, Inc.), and difference in reflection density under high temperature and high humidity was calculated from the transmission density under normal temperature and normal humidity, and the difference was evaluated on the basis of the following criteria.

A: density difference of 0.04 or smaller

B: density difference of larger than 0.04 and 0.07 or smaller

C: density difference of larger than 0.07

Evaluation of Cleanability

By using the copier "bizhub PRESS (registered trademark) C1070" (from Konica Minolta, Inc.), a test image with five solid vertical stripes of 3 cm width was continuously printed on 10,000 A4 sheets of the wood-free paper "CF Paper" (from Konica Minolta, Inc.), and then a complete solid image was output. Reflection density was measured at five points in portions corresponding to the stripes and six points in portions not corresponding to the stripes in the complete solid image by using the fluorescent spectrodensitometer FD-7 (from Konica Minolta, Inc.), and evaluation was performed for the maximum density difference on the basis of the following criteria. Cases with a maximum density difference of 0.06 or smaller were determined as being applicable for practical use.

A: maximum density difference of 0.03 or smaller

B: maximum density difference of larger than 0.03 and 0.06 or smaller

C: maximum density difference of larger than 0.06

Results

The evaluation results for toner (1) to toner (12) are shown in Table 4.

TABLE 4

| | | Transfer properties | | Cleanability | |
|---|---|---|---|---|---|
| Classification | Toner No. | Density difference | Rating | Maximum density | Rating |
| Example 1 | Toner (1) | 0.02 | A | 0.06 | B |
| Example 2 | Toner (2) | 0.06 | B | 0.03 | A |
| Example 3 | Toner (3) | 0.05 | B | 0.03 | A |
| Example 4 | Toner (4) | 0.02 | A | 0.04 | B |
| Example 5 | Toner (5) | 0.02 | A | 0.05 | B |

TABLE 4-continued

| | | Transfer properties | | Cleanability | |
|---|---|---|---|---|---|
| Classification | Toner No. | Density difference | Rating | Maximum density | Rating |
| Example 6 | Toner (6) | 0.03 | A | 0.03 | A |
| Example 7 | Toner (7) | 0.03 | A | 0.02 | A |
| Example 8 | Toner (8) | 0.03 | A | 0.02 | A |
| Example 9 | Toner (9) | 0.04 | A | 0.02 | A |
| Comparative Example 1 | Toner (10) | 0.01 | A | 0.13 | C |
| Comparative Example 2 | Toner (11) | 0.02 | A | 0.08 | C |
| Comparative Example 3 | Toner (12) | 0.11 | C | 0.03 | A |

As shown in Table 4, toner (10) and toner (11), whose number fraction of a toner particle containing titanium dioxide was less than 0.1%, was insufficient in cleanability. This is presumably because the toner excessively adhered to the photoconductor and the cleaning member failed to remove the toner. Toner (12), whose number fraction of a toner particle containing titanium dioxide was more than 2.0%, was insufficient in transfer properties. This is presumably because the toner had low chargeability as a whole.

In contrast, each of toner (1) to toner (9), whose number fraction of a toner particle containing titanium dioxide was 0.1% or more and 2.0% or less, was sufficient in transfer properties and cleanability. This is presumably because each toner had proper chargeability and assisted removal of residual toner on the photoconductor by virtue of the proper content of a toner particle containing titanium dioxide.

In particular, each of toner (6) to toner (9), whose number fraction of a toner particle containing titanium dioxide was 0.3% or more and 1.0% or less and whose content of titanium element derived from titanium dioxide on average per toner particle was 0.04 mass % or more and 0.50 mass % or less, was further sufficient in transfer properties and cleanability.

INDUSTRIAL APPLICABILITY

The toner according to the present invention for development of an electrostatic latent image provides good transfer properties and cleanability in formation of an image, and thus allows formation of an image of high quality. Accordingly, the present invention is expected to contribute to further popularization of electrophotographic image forming methods.

Although embodiments of the present invention have been described and illustrated in detail, it is clearly understood that the same is by way of illustration and example only and not limitation, the scope of the present invention should be interpreted by terms of the appended claims.

What is claimed is:

1. A toner for electrostatic charge development, comprising a toner particle, the toner particle comprising: a toner base particle containing a binder resin and a release agent; and an external additive containing titanium dioxide, wherein the number fraction of the toner particle containing the titanium dioxide is 0.1% or more and 2.0% or less.

2. The toner for electrostatic charge development according to claim 1, wherein the number fraction of the toner particle containing the titanium dioxide is 0.3% or more and 1.0% or less.

3. The toner for electrostatic charge development according to claim 1, wherein the content of titanium element derived from the titanium dioxide on average per toner particle is 0.01 mass % or more and 1.00 mass % or less.

4. The toner for electrostatic charge development according to claim 1, wherein the content of titanium element derived from the titanium dioxide on average per toner particle is 0.04 mass % or more and 0.50 mass % or less.

* * * * *